United States Patent [19]

Esslinger

[11] Patent Number: 4,564,125

[45] Date of Patent: Jan. 14, 1986

[54] BB LOADER

[76] Inventor: James J. Esslinger, 1314 N. Drexel Ave., Indianapolis, Ind. 46201

[21] Appl. No.: 602,553

[22] Filed: Apr. 20, 1984

[51] Int. Cl.[4] ..... F41C 25/00; A47F 1/00

[52] U.S. Cl. ..... 221/288; 124/45; 221/306; 222/456; 141/333

[58] Field of Search ..... 124/45, 48, 49, 50, 124/80; 221/306, 307, 312 C, 303, 288; 222/572, 456; 141/331-334; 206/536

[56] References Cited

U.S. PATENT DOCUMENTS

| | | | |
|---|---|---|---|
| 236,997 | 1/1881 | Dodge | 222/456 |
| 834,014 | 10/1906 | Lyke | 222/456 UX |
| 1,955,559 | 4/1934 | Narrow | 124/45 X |
| 2,814,285 | 11/1957 | Yamauchi | 124/49 X |
| 3,178,081 | 4/1965 | Adams | 222/456 |
| 3,263,664 | 8/1966 | Bauer et al. | 124/49 |
| 3,308,996 | 3/1967 | Beck | 222/456 |
| 3,789,891 | 2/1974 | Bosch | 124/49 X |
| 4,020,974 | 5/1977 | Bauer et al. | 124/50 X |
| 4,282,990 | 8/1981 | Miyashita | 222/456 X |

*Primary Examiner*—Paul E. Shapiro
*Attorney, Agent, or Firm*—Leonard Bloom

[57] ABSTRACT

An improved BB loader has a trough formed within a lateral extension of a tubular housing, so that a predetermined quantity of BB's may be quickly loaded into the trough from the reservoir in the housing. Thereafter, substantially the entire predetermined quantity of BB's may be dispensed out of the trough in the housing (substantially all at once and in a row) and through a chute mounted on the front of the housing. Preferably, the trough communicates with the reservoir through a longitudinal slot formed in the housing; the slot has a transverse width sufficient to accommodate one BB, while the trough has a transverse width to accommodate two BB's.

7 Claims, 11 Drawing Figures

10
11
18
21
27
22

10
11
18
21
27

10
18
31
32

10
18
31
32

BB LOADER

FIELD OF INVENTION

The present invention relates to an improved BB loader, and more particularly, to a BB loader which conveniently dispenses substantially a predetermined quantity of BB's, as for example 20, by a simple pivotal movement of the loader.

BACKGROUND OF THE INVENTION

In the prior art of which I am aware, various dispensers have been disclosed for dispensing all types of articles, such as pills, usually by a metering of the articles—one by one—out of the dispenser. These dispensers are not suitable for use in BB guns, however, since the individual metering action would be too time-consuming. In an apparent effort to correct this deficiency, the Tratsch U.S. Pat. No. 2,456,159 has disclosed a tubular dispenser for dispensing a substantial quantity of BB's into the gun in a single movement. However, the BB's must first be loaded into the tubular dispenser (one by one) which is also tedious and time-consuming.

SUMMARY OF INVENTION

Accordingly, it is an object of the present invention to provide an improved BB loader for easily and conveniently dispensing a substantial predetermined quantity of BB's by a simple pivotal movement of the dispenser.

It is another object of the present invention to provide an improved BB loader that is relatively small, portable and lightweight, and which may be manufactured easily and economically.

In accordance with the teachings of the present invention, the improved BB loader includes a housing having a forward end, a rearward end, and a reservoir therebetween. The housing is provided with an internal longitudinal slot formed therein, the slot running laterally along the reservoir. A dispensing trough is formed in a member carried by the housing, longitudinally thereof, and having a width sufficient to accommodate two BB's. The trough covers the longitudinal slot in the housing and is in communication with the reservoir and extends substantially the full length thereof. The purpose of the trough is to dispense a predetermined quantity of BB's out of the trough, yet without emptying the entire reservoir all at once. A chute is carried on the forward end of the housing and is in communication with the forward end of the trough. With this arrangement, a predetermined quantity of BB's may be loaded into the trough from the reservoir, and then substantially the entire predetermined quantity of BB's may be dispensed in a row out of the trough and through the chute.

These and other objects of the present invention will become apparent from a reading of the following specification taken in conjunction with the enclosed drawings.

DESCRIPTION OF THE PREFERRED EMBODIMENT

Figures 1, 2, 3, 4, 9, 10, 11:
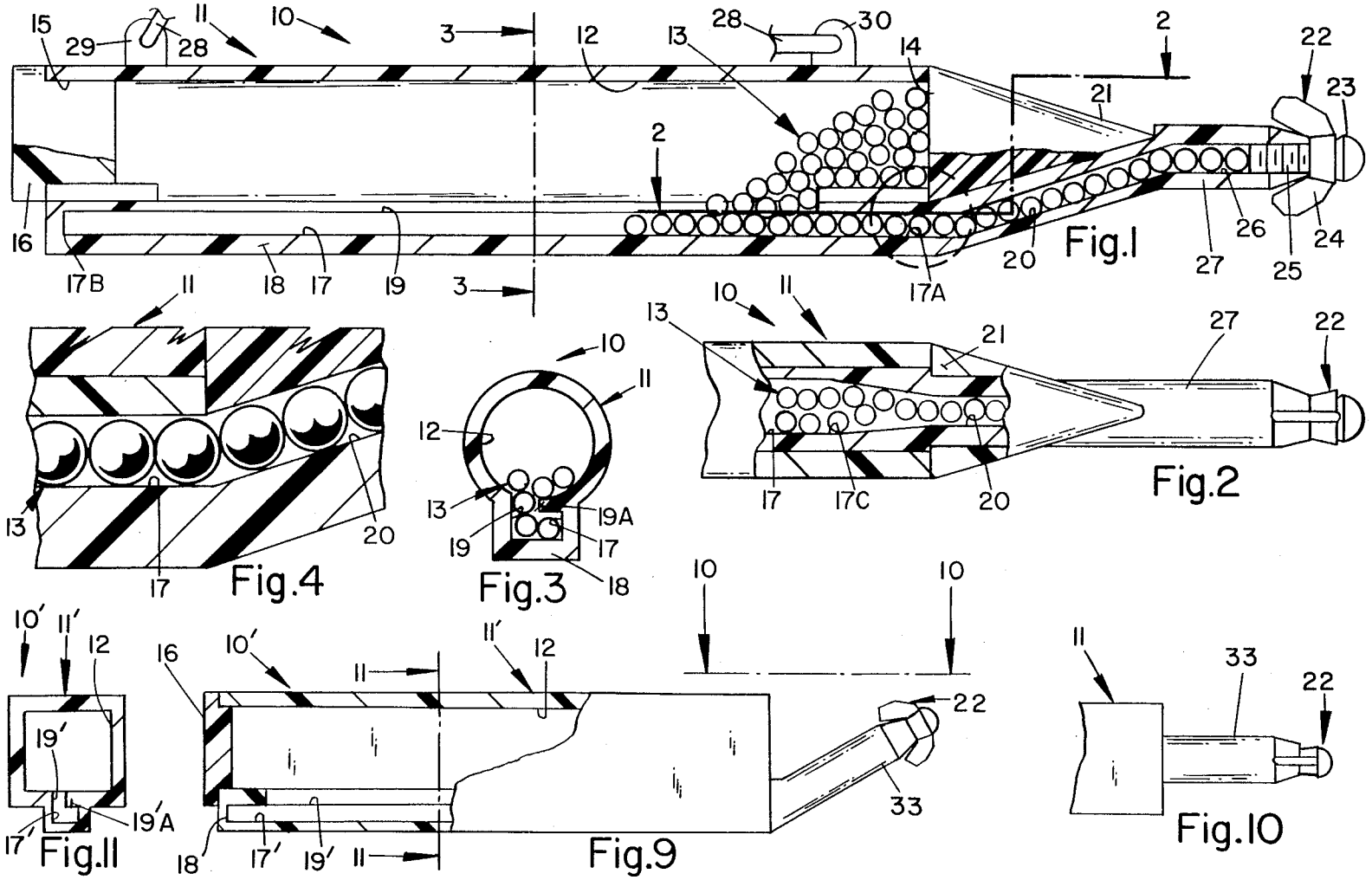
FIG. 1 is a side elevation of a preferred embodiment of the improved BB loader of the present invention, with parts broken away and sectioned.
FIG. 2 is a sectional view, taken along the lines 2—2 of FIG. 1, and showing the internal closed longitudinal slot formed in the tubular housing laterally thereof.
FIG. 3 is a transverse sectional view, taken across the lines 3—3 of FIG. 1.
FIG. 4 is an enlarged portion of FIG. 2, showing the BB's being dispensed out of the trough and into the chute.
FIG. 9 is a side elevation of an alternate embodiment of the BB loader of the present invention.
FIG. 10 is a section view, taken along the lines 10—10 of FIG. 9.
FIG. 11 is a partial top plan view, taken along the lines 11—11 of FIG. 9.

With reference to FIGS. 1-3, the improved BB loader 10 includes a housing 11 which is preferably cylindrical and tubular and has a bore 12 forming a reservoir for the BB's 13. The housing has a closed forward end 14 and an open rearward end 15. The rearward end may be closed by a removable cap 16, which has a slight press-fit with the housing (or may be threaded into the housing, if desired). Upon removal of the cap 16, a relatively-large quantity of BB's (as for example, 500) may be loaded into the reservoir in the housing.

A longitudinal trough 17 is formed in a longitudinal member 18 carried on the side of the cylindrical housing, laterally thereof. This trough 17 is open at its forward end 17A and closed at its rearward end 17B; and the trough communicates with a longitudinal slot 19 formed in the cylindrical housing, parallel to the trough 17, as shown more clearly in FIG. 3. The slot 19 has a stop or lip 19A overhanging the trough adjacent to the slot; the purpose of this lip is to contain one row of BB's in the trough while allowing any excess BB's to return to the reservoir. With this arrangement, the transverse width of the slot 19 is just slightly more than the width of one BB. A tubular chute 20 is formed within a conical forward portion 21 of the housing and is in communication with the open forward end of the trough. A removable stop 22 is carried on the forward end of the chute. The stop 22 may comprise a stud 23 press-fitted into a wing nut 24 and having a threaded shank 25 received within a tapped bore 26 in an axial extension 27 of the chute. It will be understood, of course, that any press-fit or screw-in type retainer may be used. Preferably, the chute is disposed at the lower forward portion of the housing, is inclined upwardly therefrom away from the slot, and continues into its axial extension 27.

The trough 17 has a tapered necked-down portion 17c forwardly thereof (as shown more clearly in FIG. 2) to form a channel to accommodate the width of only one BB into the chute 20.

A strap 28 is mounted on bosses 29 and 30 on top of the housing, opposite to the lateral extension on the bottom of the housing, to facilitate a convenient carrying and use of the loader. In lieu of the strap, any suitable handle means may be employed, if desired.

Figures 5, 6, 7, 8:
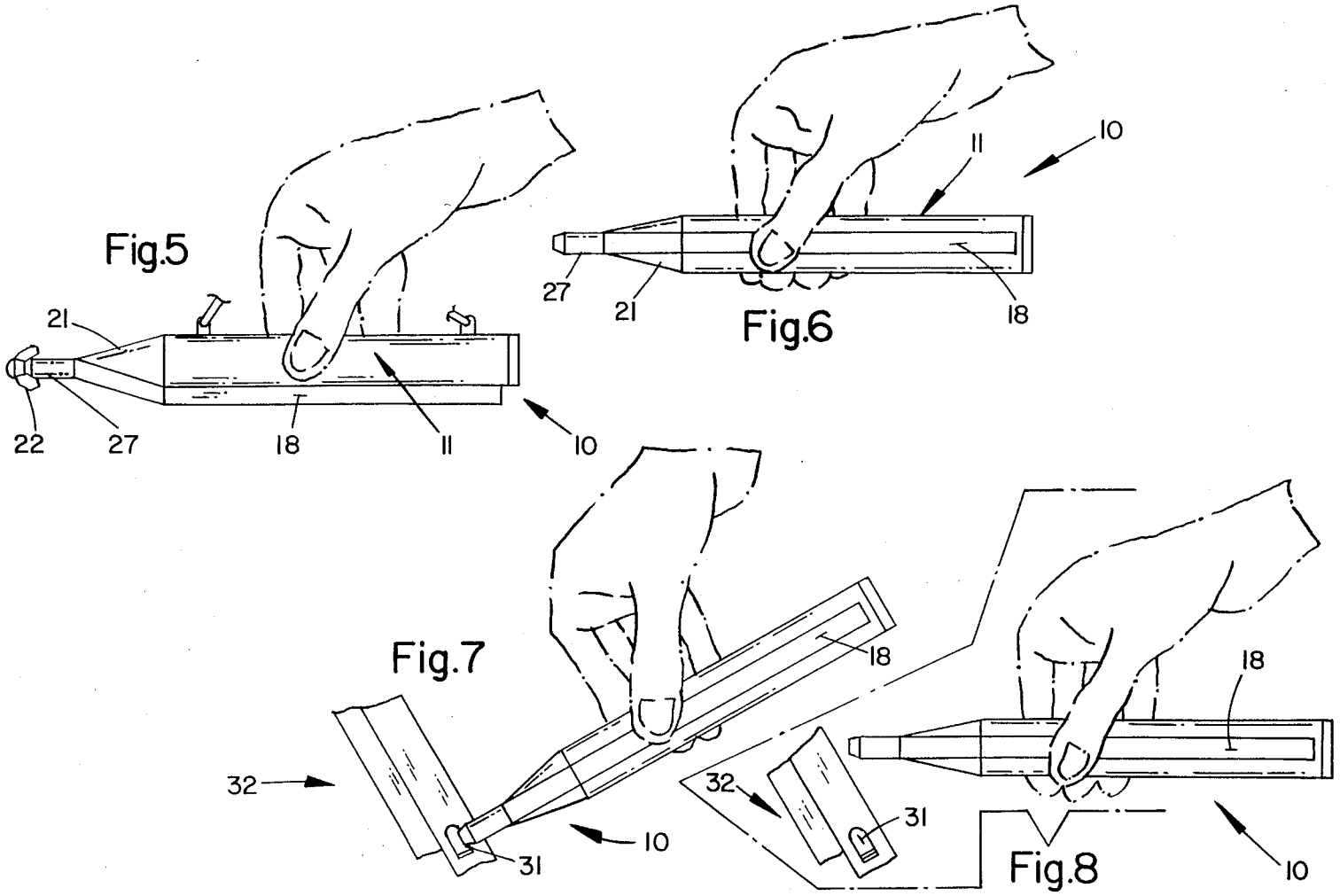
FIG. 5 is a pictorial view, illustrating how a substantial predetermined quantity or row of BB's may be loaded into the trough by merely positioning the housing so that the trough is below the reservoir.
FIG. 6 is a further pictorial view, corresponding substantially to FIG. 5, but showing the housing turned substantially at right angles from the FIG. 5 position, so that the row of BB's is substantially trapped in the trough.
FIG. 7 is a further pictorial view, corresponding substantially to FIG. 6, but illustrating how the row of BB's in the trough may be dispensed quickly by gravity feed through a chute on the forward portion of the housing and into the BB rifle or other BB gun.
FIG. 8 is a still further pictorial view, corresponding substantially to FIG. 7, but showing how the back end of the loader may be lowered to preclude any more BB's from being dispensed out of the loader.

As shown more clearly in FIGS. 5–8, a predetermined quantity of BB's (as for example, twenty) may be loaded into the trough 17 from the reservoir 12 by simply orienting the housing so that the trough is at the bottom thereof, as shown in FIG. 5. The BB's fall through the slot 19 in the housing 11 and into the trough 17 formed in the member 18 mounted on the housing. Thereafter, and as shown more clearly in FIG. 6, the housing 11 may be turned or rotated by around ninety degrees (more or less) so that the trough 17 is to one side of the housing, thereby positioning the row of BB's in the trough and having the BB's available for dispensing out of the trough (and the chute). Upon removal of the stop 22 on the end of the chute 20, the chute may be inserted into the breech 31 in the BB gun or rifle 32 as shown in FIG. 7; and the housing may be raised slightly (if necessary) to dispense substantially the entire predetermined quantity or row of BB's (such as twenty BB's) all at once out of the trough and through the chute into the BB gun. The number of BB's dispensed depends upon the length of the trough. The back end of the loader 10 may then be lowered, as shown in FIG. 8, to preclude any more BB's from being dispensed out of the loader.

The entire row of BB's in the trough are dispensed quickly as a group and are not individually metered into the BB gun. The process is substantially threefold: (1) loading the row of BB's in the trough; (2) pivoting the loader for positioning the BB's for subsequent dispensing; and (3) dispensing the BB's out of the loader. These steps are shown in FIGS. 5, 6 and 7, respectively. The loader is small, portable and lightweight, and may be grasped conveniently by the user.

The improved BB loader 10 of the present invention may be molded from a suitable plastic material and may be fabricated conveniently and economically for widespread marketing and distribution. Even when loaded, the BB loader 10 is relatively lightweight and may be carried easily by means of the strap 29.

With reference to FIGS. 9–11, an alternate embodiment 10' is illustrated, wherein the housing is square cross-sectioned, and wherein a single tubular chute 33 is inclined upwardly therefrom and is in communication with the trough in the housing. (In FIGS. 9–11, the same numbers have been used to indicate the parts substantially identical to those in the embodiment of FIGS. 1–4.)

Obviously, many modifications may be made without departing from the basic spirit of the present invention. Accordingly, within the scope of the appended claims, the invention may be practiced other than has been specifically described therein.

I claim:

1. A BB loader comprising a housing having a forward end and a rearward end and further having a reservoir therebetween for storage of BB's, the housing further having a longitudinal trough means formed therein laterally of the reservoir and in communication therewith, the trough means having an open forward end and a closed rearward end, and chute means carried by the forward end of the housing and in communication with the forward end of the trough means, whereby a substantially predetermined quantity of BB's may be loaded into the trough means from the reservoir, and whereby subsequently, substantially the entire predetermined quantity of BB's may be dispensed as a row out of the trough means and through the chute means, wherein the trough means comprises a longitudinal member carried on the side of the housing, the longitudinal member having a trough formed therein, the trough having a transverse width sufficient for two BB's side-by-side, and the housing having a longitudinal slot formed therein and communicating the reservoir with the trough, the longitudinal slot having a transverse width sufficeint to accommodate one BB.

2. The BB loader of claim 1, wherein the trough has a forward necked-down portion in communication with the chute means.

3. The BB loader of claim 1, further including a lip between the slot and the trough.

4. A BB loader comprising a substantially cylindical tubular housing forming a reservoir for BB's and having a closed forward end and an open rearward end, a removable cap on the rearward end of the housing, whereby BB's may be loaded into the reservoir, the housing having a longitudinal member provided with a trough formed therein, the trough having an open forward end and a closed rearward end, the housing having a longitudinal slot formed therein, parallel to the trough and communicating the trough with the reservoir, the longitudinal slot having a transverse width sufficient for the passage of one BB, a tubular chute carried by the forward end of the housing and inclined upwardly relative thereto, the chute being in communication with the trough, the trough having a transverse width sufficient to accommondate two BB's side-by-side, the trough being in communication with the chute and further having a necked-down forward portion having a transverse width sufficient for the passage of just one BB, and a removable stop on the chute, whereby a substantially predetermined quantity of BB's may be loaded into the trough from the reservoir in the housing by orienting the housing so that the trough is substantially on the bottom thereof, whereby upon turning of the housing so that the trough is laterally disposed to one side of the housing, the quantity of BB's are available for dispensing, and whereby upon removal of the stop on the chute and elevating the rearward end of the housing, substantially the entire predetermined quantity of BB's may be dispensed out of the trough and through the chute.

5. The BB loader of claim 4, further including a strap carried by the housing on a side thereof substantially opposite to the trough.

6. The BB loader of claim 4, wherein the trough and the longitudinal slot are parallel to the axis of the cylindrical tubular housing.

7. In a BB loader, the combination of a housing including a reservoir having a longitudinal slot formed therein, a member carried by the housing laterally thereof, the member having a trough formed therein in communication with the slot, a lip overhanging the trough adjacent to the slot, whereby the slot has a transverse width to accommodate only one BB, the trough having a transverse width to accommodate at least two BB's, the trough further having a tapered necked-down portion forming a channel to accommodate only one BB, and chute means in communication with the necked-down portion of the trough to dispense the BB's substantially in a row out of the housing.

* * * * *